US005415510A

United States Patent [19]

Funaki et al.

[11] Patent Number: 5,415,510

[45] Date of Patent: May 16, 1995

[54] HEAT INSULATING SUPPORT TOOL FOR CONCRETE WALL AND CONCRETE WALL STRUCTURE USING SAME

[75] Inventors: Motokatsu Funaki; Noboru Yamasaka; Chikara Funaki; Satoru Watanabe, all of Kanagawa, Japan

[73] Assignee: Gantan Beauty Industry Company, Ltd., Kanagawa, Japan

[21] Appl. No.: 127,345

[22] Filed: Sep. 28, 1993

[30] Foreign Application Priority Data

Sep. 30, 1992 [JP] Japan ..... 4-262253
Dec. 24, 1992 [JP] Japan ..... 4-344591

[51] Int. Cl.[6] ..... F16B 35/00; F16B 39/02; E04B 1/38; E04C 5/00

[52] U.S. Cl. ..... 411/384; 411/82; 52/508; 52/699; 52/703; 52/707

[58] Field of Search ..... 411/107, 383, 384, 397, 411/82; 52/506.05, 508, 509, 512, 513, 704, 707, 699, 703

[56] References Cited

U.S. PATENT DOCUMENTS 2,625,815 1/1953 Black ..... 52/707 X
2,879,660 3/1959 Reintjes ..... 411/384 X
3,367,620 2/1968 Holt .
3,715,850 2/1973 Chambers ..... 52/707 X
5,251,993 10/1993 Sigourney ..... 411/384 X
5,283,992 2/1994 Morassutti ..... 52/704 X
5,333,423 8/1994 Propst ..... 52/508 X

FOREIGN PATENT DOCUMENTS 0016468 10/1980 European Pat. Off. .
1547267 10/1968 France .
128779 2/1969 Germany .
1117997 6/1968 United Kingdom .

*Primary Examiner*—Neill R. Wilson
*Attorney, Agent, or Firm*—Sandler, Greenblum & Bernstein

[57] ABSTRACT

A heat insulating support tool is provided for a concrete wall structure. The support tool may include a pedestal member having a through-hole extending axially through the pedestal member, a fixing rod-like member extending through the through-hole of the predestal member, and a spacing holding rod-like member embedded in the concrete wall. The fixing rod-like member may include a rotating member at a front end thereof and an enlarged head member at a rear end thereof. In addition, a connecting device may be provided for connecting one end of the spacing holding rod-like member to the fixing rod-like member so that the connection of the spacing holding rod-like member and the fixing rod-like member can be released by rotating the rotating member.

15 Claims, 12 Drawing Sheets

HEAT INSULATING SUPPORT TOOL FOR CONCRETE WALL AND CONCRETE WALL STRUCTURE USING SAME

FIELD OF THE INVENTION

The present invention relates to a heat insulating support tool for a concrete wall and a concrete wall structure using the support tool.

BACKGROUND OF THE INVENTION

According to the prior art, in the case of applying some finish material onto the surface of a concrete frame (a heat insulating layer) formed by a concrete form construction method (including the formation of an insulating layer), anchors are driven into the concrete frame after curing and hardening and then the finish material is applied onto the anchors.

In the anchor driving work, however, it is necessary to perform marking on the finish material applying surface, thus requiring a double labor, and hence the working efficiency is poor.

As to a spacing holding member (e.g. bolt member) which is embedded in concrete in the conventional form construction method, since a single bolt is embedded as it is through concrete, it acts as a heat bridge or a cool bridge, resulting in impairment of the heat insulating performance.

Further, a bolt integrated type holder member, or a holder member with a bolt portion, attached to the aforesaid bolt member used in the conventional form construction method is removed together with presser members such as, for example, square lumbers or steel pipes, called vertical battens and horizontal battens, in order to make the concrete surface after concrete placing into a flat surface free of projection. Then, a recess appearing in the concrete surface after removal of such holder member with bolt portion is filled up with some joint filler to finish the concrete surface flat. These operations have been very troublesome.

With respect to the heat insulating support tool for concrete wall, the following problems must also be taken into consideration, in addition to the above-mentioned problems relating to outside insulation performance, joint filler filling operation into a recess and anchor driving for a finish material.

1. Problem Relating to the Fracture of Support Tool

Impact force and tensile force generated at the time of concrete piecing are imposed on the support tool through forms, so in the case where a resin material or the like is incorporated in a middle portion of the support tool for the purpose of heat insulation, there is a fear of fracture of the support tool because of insufficient measure against such impact force and tensile force.

2. Problem Relating to the Application of Finish Material

Since finish materials (external facing materials) are applied in various thicknesses, in the case where the length of a bolt member used is inappropriate, for example, when it is too long, it may be impossible to tighten the bolt with a ready-made form tie, or it may be necessary to replace it with another bolt having an appropriate length. Further for facilitating the mounting of a finish material, it is desired that the bolt member protrude at in a predetermined outside position and be stable in that position.

3. Problem Relating to the Bolt Mounting Accuracy

In the event the bolt member used is not mounted in a predetermined position, there arises a displacement in the axial direction of the bolt member, thus making it impossible to ensure a concrete space of a required width.

SUMMARY OF THE INVENTION

It is an object of the present invention to provide a heat insulating support tool for a concrete wall which has overcome all of the above-mentioned problems, that is, the problem relating to outside insulation performance, problem relating to the joint filler filling work into a recess, problem relating anchor driving for a finish material, problem relating to fracture of the support tool, problem relating to the application of a finish material and problem relating to the bolt mounting accuracy.

It is another object of the present invention to provide a superior concrete wall structure using the said heat insulating support tool.

According to the present invention, in order to achieve the above-mentioned objects, in a heat insulating support tool for a concrete wall, the support tool comprises a pedestal member and a fixing rod-like member, the pedestal member having a through-hole extending from a surface portion which abuts the back of a front-side form up to a back portion, the through-hole having a hole portion on the back side which hole portion is larger in its inside diameter than the front portion, the fixing rod-like member having a threaded portion and a rotating portion at an outside end thereof and having at an inside end thereof an enlarged head portion smaller in diameter than the large-diameter hole portion, the outside end of the fixing rod-like member being protruded from the through-hole to the surface portion, and a spacing holding rod-like member which is embedded in concrete is connected to the inside end of the fixing rod-like member in such a manner that the connection can be released by rotating the rotating portion. This construction can afford the following effects.

Since the interconnected state of the fixing rod-like member and the spacing holding rod-like member can be released by rotating the rotating portion of the fixing rod-like member, both rod-like members can be separated from each other by disconnection after concrete placing, whereby a sufficient heat insulating ability is ensured without influence of heat bridge and cool bridge and the problem relating to the outside insulation performance can be solved.

Since the problem of heat insulation relating to heat bridge and cool bridge is solved, by using the projecting end portion of the fixing rod-like member as a support portion for a finish material after concrete placing, it is made possible to execute the application of the finish material without the need of separately driving anchors, whereby the problem relating to the joint filler filling work into a recess and the problem relating to anchor driving for a finish material can be solved.

Moreover, since the inside end of the fixing rod-like member and the spacing holding rod-like member are directly connected to each other, both impact force and tensile force at the time of concrete placing are imposed on both rod-like members, so there is no fear of the pedestal member being damaged by an external pressure during concrete placing and hence it is possible to overcome the problem relating to the fracture of the support tool.

Further, since the problem of heat insulation relating to heat bridge and cool bridge is solved and the enlarged a head portion of the fixing rod-like member is in abutment with the bottom of the large-diameter portion to prevent dislodgement of the fixing rod-like member from the pedestal member, the application of a finish material can be done using the projecting end portion of the fixing rod-like member as a support portion for the finish material; besides, as to the fixing rod-like member, it is possible to freely adjust its protrusion level to the outside of the front-side form, so it is possible to make level adjustment easily according to a finish thickness of the finish material used and hence possible to solve the problem involved in the application of a finish material.

In another aspect of the present invention, the pedestal member has an internally threaded hole portion formed in the through-hole thereof, and an externally threaded portion of the fixing rod-like member is threadedly engaged with the internally threaded hole portion to make a projecting length of the fixing rod-like member adjustable relative to the pedestal member. This construction can afford the following effect.

Since the protrusion level of the fixing rod-like member can be finely adjusted by turning of the same member, this fine adjustment can be made according to a finish thickness of the finish material used.

In a further aspect of the present invention, the pedestal member has an internally threaded hole portion formed in the through-hole thereof and an externally threaded portion of the fixing rod-like member is threadedly engaged with the internally threaded hole portion, the fixing rod-like member having an internally threaded portion formed on an inner surface of its enlarged head portion, with a cap member being disposed to close the opening of the large-diameter hole portion formed in the back portion of the pedestal member, and the spacing holding rod-like member is connected through a central hole portion of the cap member to the internally threaded portion of the enlarged head in the large-diameter hole portion in such a manner that the connection can be released by rotating the foregoing rotating portion of the fixing rod-like member. This construction can afford the following effects.

Since the opening of the large-diameter hole portion on the inner surface side of the pedestal member is closed with the cap member so that when the fixing rod-like member moves inwards it comes into abutment with the cap member and its rotating motion is prevented, not only the inward movement of the fixing rod-like member can be prevented, but also the rotation of the fixing rod-like member in the inside direction and co-rotation thereof with the spacings holding rod-like member can be avoided at the time of setting in the forms, whereby it is made possible to ensure a concrete space of a required width based on a predetermined mounting accuracy.

Since the large-diameter hole portion of the pedestal member is closed with the cap member, it is possible to prevent the entry of concrete and further water into the through-hole at the time of concrete placing and hence possible to rotate the fixing rod-like member without any trouble at the time of taking it outside.

In a still further aspect of the present invention, the pedestal member has an internally threaded hole formed in its through-hole, with an externally threaded portion of the fixing rod-like member being threadedly engaged with the internally threaded hole portion, and a reverse rotation preventing element comprising pawls capable of meshing with the bottom of the large-diameter hole portion located opposedly thereto in the axial direction is formed in the outside surface of the enlarged head formed at the inside end of the fixing rod-like member within the large-diameter hole portion on the back side of the through-hole.

The pawls of the reverse rotation preventing element may be formed integrally with the outside surface of the retaining portion or may be constituted by a washer generally in the shape of a coned disc spring having pawls which are twisted around the projection axis and which can engage both the outside surface of the retaining portion and the bottom of the large-diameter hole portion. In the case where the reverse rotation preventing element is such a generally coned disc spring-shaped washer, some of the pawls may be folded back toward the bottom of the large-diameter hole portion to strengthen the meshing thereof with the pedestal member. This construction can afford the following effect.

Since the reverse rotation preventing element comprising pawls capable of meshing with the bottom of the large-diameter hole portion of the pedestal member located opposedly thereto in the axial direction is formed in the outside surface of the retaining portion of the fixing rod-like member, the pawls come into mesh with the bottom of the large-diameter hole portion in an outwardly moved state of the fixing bolt member, thereby acting to prevent a reverse rotation of the fixing rod-like member, whereby the fixing rod-like member can be fixed in an outside position and thus it is possible to omit a locking device for the fixing rod-like member in that outside position.

In a still further aspect of the present invention, the pedestal member has an internally threaded hole portion in its through-hole, with an externally threaded portion of the fixing rod-like member being threadedly engaged with the internally threaded hole portion, and there is provided a rotation preventing element for the fixing rod-like member comprising a pair of mutually engageable engaging projection and engaging recess formed on the opposed surfaces of the enlarged head portion and a cap member disposed so as to close the large-diameter hole portion of the rear side of the pedestal member and having a hole for insertion therethrough of the spacing holding rod-like member, the engaging projection being formed so as to be broken when it undergoes a forced rotating force. Therefore, the strength of the engaging projection is set to a value lower than an artificial forced rotating force imposed the fixing rod-like member. This construction can afford the following effect.

Since the opening of the large-diameter hole portion on the inner surface side of the pedestal member is closed with the cap member and there is provided a rotation preventing element for the fixing rod-like member comprising a pair of mutually engageable engaging projection and engaging recess formed on the opposed surfaces of the cap member and the retaining portion of the fixing rod-like member, it is also possible to prevent an outward movement of the fixing rod-like member and it is possible to prevent the rotation of the fixing rod-like member in both inside and outside directions and co-rotation thereof with the spacing holding rod-like member at the time of setting the tool in the forms.

Further, since the engaging projection of the rotation preventing element is formed so as to be broken when it undergoes a forced rotating force, it is broken and looses its rotation preventing function as the fixing rod-like member rotates under an artificial faced rotating force imposed thereon, thus permitting an outward movement of the fixing rod-like member.

In a still further aspect of the present invention, the pedestal member is divided into a surface-side portion and a back-side portion, the surface-side portion having an appropriate length and being removable axially relative to the back-side portion. In accordance with the form thickness in concrete placing, an appropriate length of the surface-side portion is selected. As a mounting and removing means for the surface- and back-side portions there is selected a suitable means such as, for example, fitting or threading means. This construction can afford the following effect.

Since the pedestal member is divided into the surface-side portion and the inside portion and the surface-side portion, which has an appropriate length, is detachable axially relative to the inside portion, all that is required in concrete placing is a mere replacement with a surface-side portion of an appropriate length according to the form thickness.

In a still further aspect of the present invention, the opening of the large-diameter hole portion on the back side of the pedestal member through-hole is formed with a projection in corresponding and transition fit relation to the enlarged head portion formed at the inside end of the fixing rod-like member. It is optional whether the projection is annular or intermittently annular. In the latter case, the height of the projection is set at a value which does not permit entry of concrete through the gap between the opening and the enlarged head portion. The following effect is attained by this construction.

Since a projection is formed in the opening on the back side of the pedestal member through-hole in a corresponding and transition fit relation to the enlarged head portion of the fixing rod-like member, the rotating motion of the pedestal member on its own axis and that of the fixing rod-like member restrict each other loosely, whereby the pedestal member is fixed temporarily against impact and vibration at the time of concrete placing and hence the concrete placing space can be maintained at a predetermined spacing.

In a still further aspect of the present invention, the enlarged head portion of the fixing rod-like member positioned within the through-hole of the pedestal member is of a diameter larger than the outside diameter of the surface side of the pedestal member. It is optional whether the enlarged head portion is formed as an integral portion or a separate portion. The following effect is attained by this construction.

Since the enlarged head portion formed at the inside end of the fixing rod-like member has a diameter larger than the outside diameter of the surface side of the pedestal member, it is possible to restrict the maximum projection level of the fixing rod-like member, and even in the case where the pedestal member is made of resin and melts due to a fire for example after concrete placing, the enlarged head portion abuts the concrete hole portion on the site of the surface-side portion of the pedestal member and thus is prevented from dislodgement, whereby a finish material can be held so as not to come off the concrete wall.

The pedestal member used in the present invention may be formed in a suitable shape such as, for example, the shape of a cylinder or a square pillar and the outer surface thereof may be formed with projections or the like to strengthen a bonded state thereof with concrete. The material of the pedestal member is a metal or a synthetic resin, and in the case where the rod-like member is a bolt, there may be used a metal-synthetic resin composite material, with only the internally threaded portion of the through-hole being formed of a metal, or a nut member may be embedded in part of the through-hole.

The length of the large-diameter hole portion of the pedestal member is set in such a manner that the fixing rod-like member can be disconnected from the spacing holding rod-like member and move to the outside. The shape of the rotating portion of the fixing rod-like member is not specially limited if only it can be operated with any of various tools so that the rod-like member can be moved to the outside after concrete placing. For example, in order to permit the use of a spanner or the like, the shape of the rotating portion may be a square face shape such as hexagonal or square shape, or a suitable square hole shape formed in the front end of the threaded portion, or in order to permit the use of a crossed screw-driver or the like, the shape of the rotating portion may be a cross-recessed shape. Thus, a suitable shape may be selected from among known shapes. As to the length of the fixing rod-like members in the case where a heat insulating material is used in the concrete wall structure there is selected a long rod-like member which permits the mounting thereto of a heat insulating spacer.

How to mount the cap member relative to the pedestal member is not specially limited. For example, both may be retained together using a retaining projection and a retaining recess, or may be fixed together by bonding using an adhesive. Further the cap member may be fitted in the inner surface portion of the pedestal member so as to be flush with the inner surface portion, or it may be formed generally in the shape of a crown which covers the inner surface portion.

According to another example of the rotation preventing element for the fixing rod-like member, the same element is formed by crushing some of the threads of the externally threaded portion of the fixing rod-like member which is threadedly engaged with the internally threaded portion of the pedestal member, whereby when the fixing rod-like member is to be rotated, it cannot be rotated unless the rotating portion is turned with an intentionally large force.

In a still further aspect of the present invention there is provided a concrete wall structure through the formation of a concrete placing space between a surface-side form and a back-side form using the heat insulating support tool described above, characterized in that, within the concrete placing space, the surface portion of the pedestal member and the back portion of a holding member are brought into abutment with the inner surfaces of the surface- and back-side forms, with the spacing holding rod-like member being disposed between the pedestal member and the holding member, a pedestal member-side end portion of the spacing holding rod-like member is connected through the pedestal member to the inside end of the fixing rod-like member which is projecting from the surface of the surface-side form, then after depositing concrete in the concrete placing space and hardening of the concrete, the fixing rod-like member is rotated to for disconnection from the spacing holding rod-like member, then the fixing rod-like member is drawn out outwardly by a suitable length and a finish material is disposed on the projecting portion of the outside end of the fixing rod-like member. The following effects are attained by this construction.

Since there is no fear of the pedestal member being damaged by impact or tensile force induced at the time of concrete placing and impairment of the concrete placing space, it is possible to obtained a predetermined concrete wall; besides, after hardening of the concrete, since the fixing rod-like member and the spacing holding rod-like member are disconnected and separated from each other, there is attained an excellent outside insulation performance and the concrete is not influenced by heat bridge and cool bridge.

Since after hardening of the concrete the fixing rod-like member is turned for disconnection from the spacing holding rod-like member, then the fixing rod-like member is drawn out externally by a suitable length and a finish material is disposed on the projecting portion at the front end of the same same rod-like member, the concrete surface can be finished using an of finish materials of various thicknesses by merely adjusting the projection level of the fixing rod-like member.

Since the projecting end portion of the fixing rod-like member is used as a support portion for a finish material, the working efficiency is improved remarkably, thus leading to shortening of the term of work, in comparison with the prior art using anchor. Besides, since the fixing rod-like member for the finish material is embedded in the concrete through the pedestal member, there can be attained a high mounting strength in comparison with a wall structure using post-driven anchors.

In another aspect of the concrete wall structure according to the present invention, the pedestal member-side end portion of the spacing holding rod-like member passed through the hole of the cap member which is disposed so as to close the opening of the large-diameter hole formed in the back portion of the pedestal member, and the end portion is then threadedly connected with the internally threaded portion the formed in the inner surface of the enlarged head portion at the inside end of the fixing rod-like member which head portion is in contact with the cap member. The following effect is attained by this construction.

The rotation of the fixing rod-like member is restricted to prevent co-rotation thereof with the spacing holding rod-like member or a form tie, thus permitting easy mounting of the form tie, and since a concrete placing space of a predetermined width is ensured, it is possible to obtain a wall structure of a designed width.

In a further aspect of the concrete wall structure according to the present invention, an air layer is interposed between the surface-side form and the finish material. The following effect is attained by this construction.

Even if the finish material is applied prior to complete hardening of concrete, the drying of concrete proceeds in the presence of the air layer and thus it is not necessary to wait for the so-called concrete curing period. This is effective in shortening the term of work.

In a still further aspect of the concrete wall structure according to the present invention, a heat insulating spacer is interposed between the surface-side form and the pedestal member coaxially with the fixing rod-like member, and an inner surface portion of the heat insulating spacer is threadedly connected with the surface portion of the pedestal member. The following effect is attained by this construction.

Since the heat insulating spacer is interposed between the surface-side form and the pedestal member coaxially with the fixing rod-like member and its inner surface portion is threadedly connected with the surface portion of the pedestal member, it is possible to effect the positioning of the pedestal member easily even when the wall structure has a heat insulating member.

In a still further aspect of the concrete wall structure according to the present invention, a heat insulating spacer is interposed between the surface-side form and the pedestal member coaxially with the fixing rod-like member and retaining grooves are formed in the surface portion of the pedestal member, while the heat insulating spacer is formed with retaining pawls in a corresponding, axially engageable relation to the retaining grooves. The following effect is attained by this construction.

Since the heat insulating spacer is interposed between the surface- side form and the pedestal member coaxially with the fixing rod-like member and retaining grooves are formed in the surface portion of the pedestal member, while the heat a insulating spacer is formed with retaining pawls in a corresponding, axially engageable relation to the retaining grooves, it is possible to effect the positioning of the pedestal member easily and prevent the rotation of the pedestal member even when the wall structure has a heat insulating member.

The forms are each constituted by a heat insulating member such as, for example, foamed polystylene, urethane foam, foamed plate or a composite plate, or an ordinary plywood, or a combination of both, and at the time of concrete placing the forms are clamped using, for example, square lumbers or metallic pipes such as steel pipes, called vertical battens and horizontal battens. For the application of a finish material, a level adjuster or the like is attached to the fixing rod-like member, and a tile facing produced by a dust pressed process or a metallic external facing is attached to a rafter or a furring strip fixed to the level adjuster. As to the heat insulating spacer, a suitable length of such spacer is selected according to the thickness of the heat insulating material used at the time of concrete placing.

In a concrete wall structure having finish members disposed on both sides thereof, the holding member may be substituted by a pedestal member, that is, pedestal members may be disposed in abutment with both surface- and back-side forms and interconnected through a spacing holding rod-like member.

BRIEF DESCRIPTION OF THE DRAWINGS

FIGS. 22 and 23 illustrate, in the order of execution of work, a first embodiment of a concrete wall structure according to the present invention, of which FIG. 22 is a vertical sectional view showing a first process and FIG. 23 is a like view showing a fourth process;

FIGS. 25 to 27 illustrate, in the order of execution of work, a third embodiment of a concrete wall structure according to the present invention, of which FIG. 25 is a vertical sectional view showing a first process, FIG. 26 is a similar view showing a third process and FIG. 27 is a similar view showing a fourth process; and FIGS. 28 and 29 illustrate, in the order of execution of work a fourth embodiment of a concrete wall structure according to the present invention, of which FIG. 28 is a vertical sectional view showing a first process and FIG. 29 is a like view showing a fourth process.

EMBODIMENTS

Figure 1:
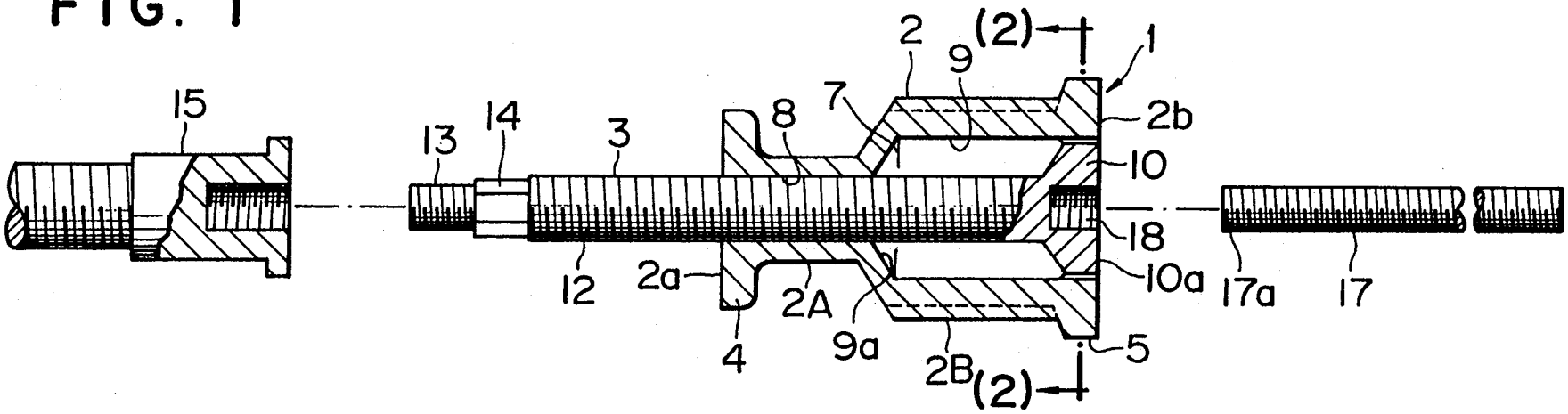
FIG. 1 is an exploded side view partially in section, showing a first embodiment of a heat insulating support tool for a concrete wall according to the present invention.
Figure 2:
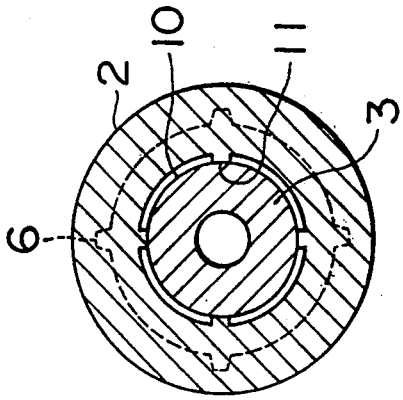
FIG. 2 is a sectional view taken on line (2)—(2) in FIG. 1.

Referring to FIGS. 1 and 2, there is illustrated a first embodiment of a heat insulating support tool according to the present invention, in which the support tool, indicated by a numeral 1, is composed of a pedestal member 2 and a fixing bolt member 3. As to the pedestal member 2, which is formed by molding a resin into a cylindrical shape of a s suitable length, a front flange 4 is formed at the front edge of a surface-side portion 2A of a small diameter, while a rear flange 5 is formed at the rear edge of a back-side portion 2B of a large diameter, and ridges 6 are formed axially on the outer peripheral surface of the back-side portion 2B. In an embedded state in concrete, the front and rear flanges 4, 5 hold concrete therebetween and act to restrict axial movements of the pedestal member 2, and the ridges 6 are bonded to the concrete to restrict movements around the axis of the pedestal member 2.

A through-hole 7 is formed from a surface part 2*a* of the surface-side portion 2A up to an inner surface part 2*b* of the back-side portion 2B. In the through-hole 7, an internally threaded portion 8 is formed on the side of the surface-side portion 2A, while a large-diameter portion 9 is formed on the side of the back-side portion 2B. The large-diameter hole portion 9 has a diameter larger than the outside diameter of the surface-side portion 2A and also larger than the outside diameter of an enlarged head portion 10 of the fixing bolt member 3 which will be described later, and it has a length which permits axial movement of the enlarged head portion 10. The opening on the inner surface part 2*b* side of the large-diameter hole portion 9 is formed with lugs 11 in a transition fit relation to the enlarged head portion 10.

The fixing bolt member 3 extending through the through-hole 7 of the pedestal member 2 has an externally threaded portion 12 formed on the outer peripheral surface thereof and engaged threadedly with the internally threaded portion 8. An outer end of the fixing bolt member 3 which outer end can protrude to the surface side through a surface-side form is formed with a threaded portion 13 and a hexagonal rotating portion 14 so that a bolt member 15 for holding a presser member or a level adjuster 16, which will be explained later in connection with a concrete as wall structure according to the invention, can be mounted to the threaded portion 13. Further, by turning the rotating portion 14, the projection level of the fixing bolt member 3 relative to the pedestal member 2 can be adjusted, and the fixing bolt member 3 can be disconnected from a spacing holding bolt member 17 which will be explained later.

At an inside end of the fixing bolt member 3 is formed an enlarged head portion 10 having an outside diameter larger than that of its surface-side portion, whereby the projection level of the fixing bolt member 3 can be adjusted until abutment of the enlarged head portion 10 with a bottom 9*a* of the large-diameter hole portion 9 and the fixing bolt member is prevented from coming out from the pedestal member 2 at the maximum projection level. In an inside surface 10*a* of the enlarged head portion 10 of the fixing bolt member 3 is formed an internally threaded portion 18 coaxially, with which is threadedly connected one end portion 17*a* of the spacing holding bolt member 17 which will be explained later. To an opposite end portion 17*b* of the spacing holding bolt member 17 can be attached a holding member 52 which will be explained later.

Thus, since the inside end of the fixing bolt member 3 extending through the through-hole 7 of the pedestal member 7 and the spacing holding bolt member 17 embedded in a concrete placing space are directly connected with each other, impact and tensile forces induced at the time of concrete placing are imposed on both bolt members 3 and 17, so there is no fear of the pedestal member 2 being damaged by an external pressure during concrete placing.

Moreover, since the connected state between the fixing bolt member 3 and the spacing holding bolt member 17 can be released by turning the rotating portion 14 of the fixing bolt member, both bolt members 3 and 17 can be separated from each other by disconnection after concrete placing, so there is no influence of heat bridge and cool bridge and a satisfactory heat insulating performance can be attained.

Further, since the problem of heat insulation relating to heat bridge and cool bridge is overcome, the application of a finish material can be done using the threaded portion 13 or externally threaded portion 12 of the fixing bolt member 3 as a support portion for the finish material, that is, without the need of driving an anchor separately. Besides, since the projection level of the fixing bolt member 3 to the outside of the surface-side form can be adjusted by suitably turning the rotating portion 14 of the bolt member 3 it is possible to make the level adjustment easily in accordance with the finishing thickness of the finish material.

Further, since the enlarged head portion 10 is formed at the inside end of the fixing bolt member 3 so as to have an outside diameter larger than that of the surface-side portion 2A of the pedestal member 2, thereby causing the enlarged head portion 10 to come into abutment with the bottom of the large-diameter hole portion 9 on the side of the back-side portion 2B in the through-hole 7 of the pedestal member 2 to prevent its dislodgement, it is possible to restrict the maximum projection level of the fixing bolt member 3. Particularly, even when the pedestal member 2 is made of resin and melts due to a fire for example after concrete placing, the enlarged head portion 10 abuts the concrete hole portion at the site of the surface-side portion 2A of the pedestal member 2 and is thereby prevented from dislodgement, and thus it is possible to continue holding the finish material lest the finish material should come off the concrete wall.

Since the opening on the inner surface part **2*b* side in the through-hole 7 of the pedestal member 2 is formed with lugs 11 in a corresponding, transition fit relation to the enlarged head portion 10 of the fixing bolt member 3, the pedestal member 2 and the fixing bolt member 3** restrict their rotating motions on their own axes loosely with respect to each other, so that the pedestal member is temporarily fixed so as not to move under impact and vibration during concrete placing, whereby the concrete placing space can be maintained at a predetermined spacing.

When the pedestal member 2 is embedded in concrete, the front and rear flanges 4, 5 hold the concrete therebetween and act to restrict axial movements of the pedestal member, while the ridges 6 are bonded with the concrete and act to restrict movements of the pedestal member 2 around the axis thereof, so that there can be obtained a high mounting strength in comparison with a wall structure using a post-driven anchor.

Figure 3:
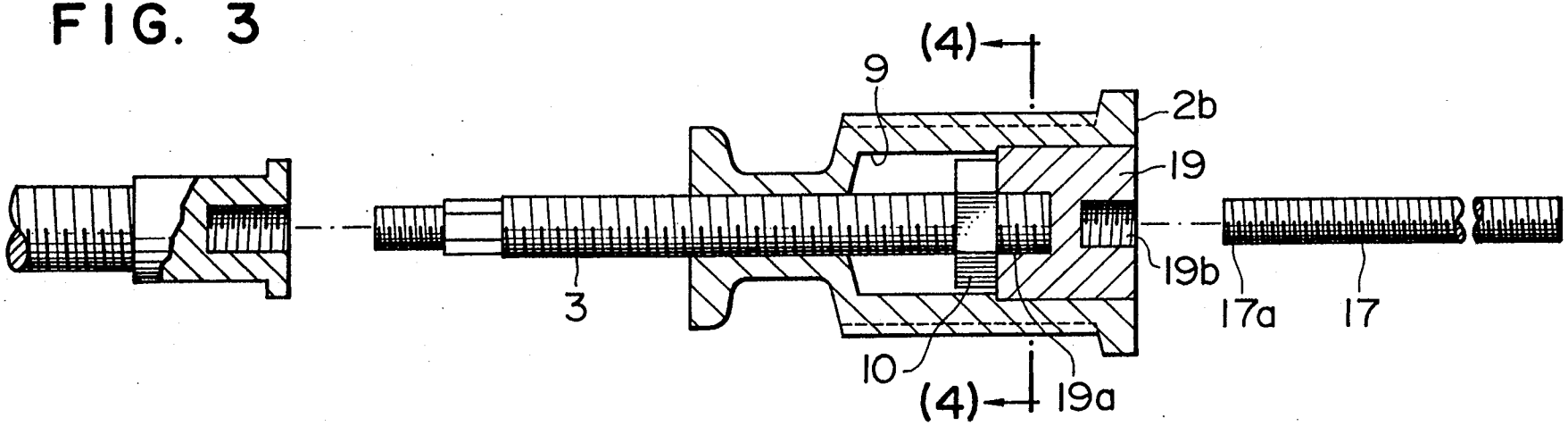
FIG. 3 is an exploded side view partially in section, showing a second embodiment of a heat insulating support tool for a concrete wall according to the present invention.
Figure 4:
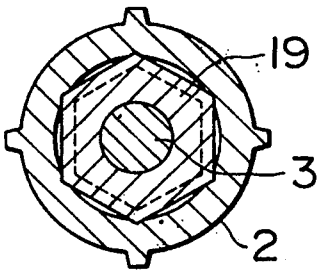
FIG. 4 is a sectional view taken on line (4)—(4) in FIG. 3.

FIGS. 3 and 4 illustrate a second embodiment of a heat insulating support tool for a concrete wall according to the present invention. The construction of this second embodiment is basically the same as that of the previous first embodiment, so the explanation of constructional points common to both will be omitted and explanation of different constructional points will be given below.

A fixing bolt member 3 and a spacing holding bolt member 17 are connected with each other through a metallic nut-like connecting member 19. The connecting member 19 is press-fitted and fixed on an inner surface part **2*b* side of a large-diameter hole portion 9 and it has an internally threaded portion 19*a* formed on the surface side and an internally threaded portion 19*b* on the back side. An inside end of the fixing bolt member 3 and one end portion 17*a* of the spacing holding bolt member 17 are threadedly engaged with the internally threaded portions 19*a* and 19*b*, respectively, whereby both bolt members 3 and 17 are integrally connected with each other. An enlarged head portion 10 is formed near the inside end of the fixing bolt member 3 to make level adjustment possible and so as not to be an obstacle to the threaded engagement with the internally threaded portion 19*a***.

By the above construction of the second embodiment there are attained the same functions and effects as in the first embodiment.

Figure 5:
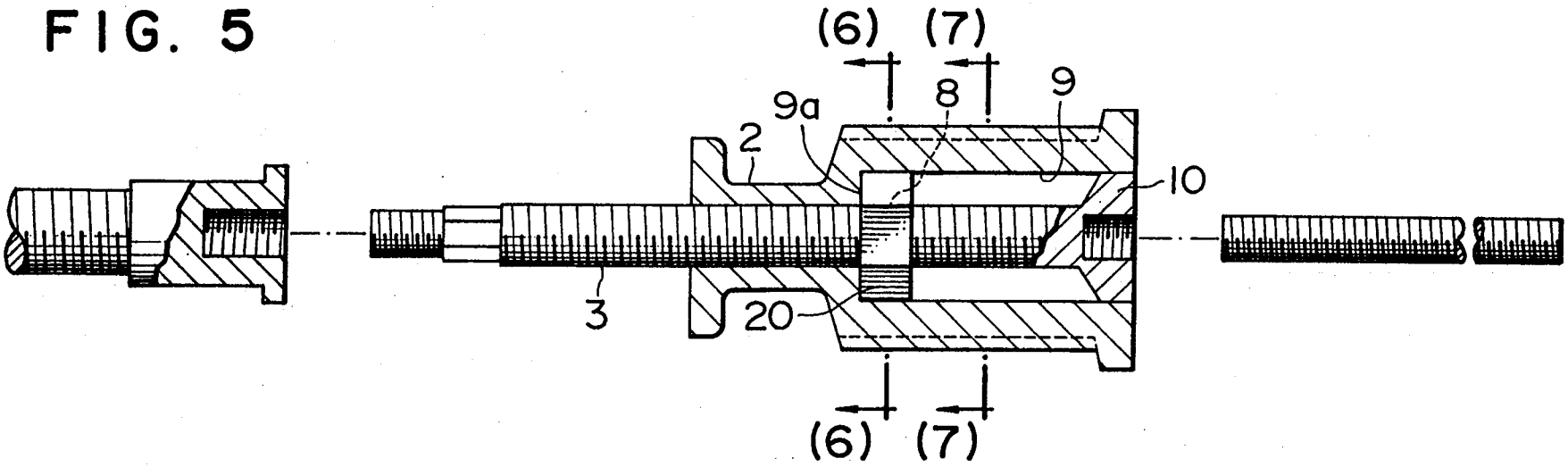
FIG. 5 is an exploded side view partially in section, showing a third embodiment of heat insulating support tool for a concrete wall according to the present invention.
Figure 7:
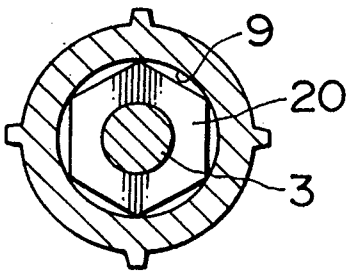
FIG. 7 is a sectional view taken on line (7)—(7) in FIG. 5.
Figure 6:
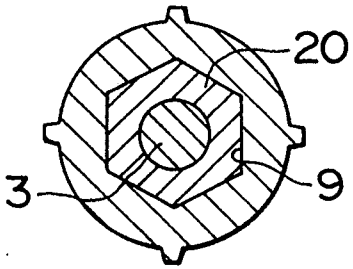
FIG. 6 is a sectional view taken on line (6)—(6) in FIG. 5.

FIGS. 5 to 7 illustrate a third embodiment of a heat insulating support tool for a concrete wall according to the present invention. The construction of this third embodiment is basically the same as that of the first embodiment, so the explanation of constructional points common to both will be omitted and explanation of different constructional points will be given below.

A metallic nut 20 as an internally threaded portion 8 is embedded in a bottom **9*a* of a large-diameter hole portion 9 of a pedestal member 2. In this mode, the nut 20 serves as the bottom 9*a*, and lugs 11 are not used, in other words, the large-diameter hole portion 9 and an enlarged head portion 10** are formed in a transition fit relation to each other.

By such construction of the third embodiment there are attained the same functions and effects as in the first embodiment; besides, the threaded engagement between the fixing bolt member 3 and the pedestal member 2 is strengthened to provide a strong structure.

Figure 8:
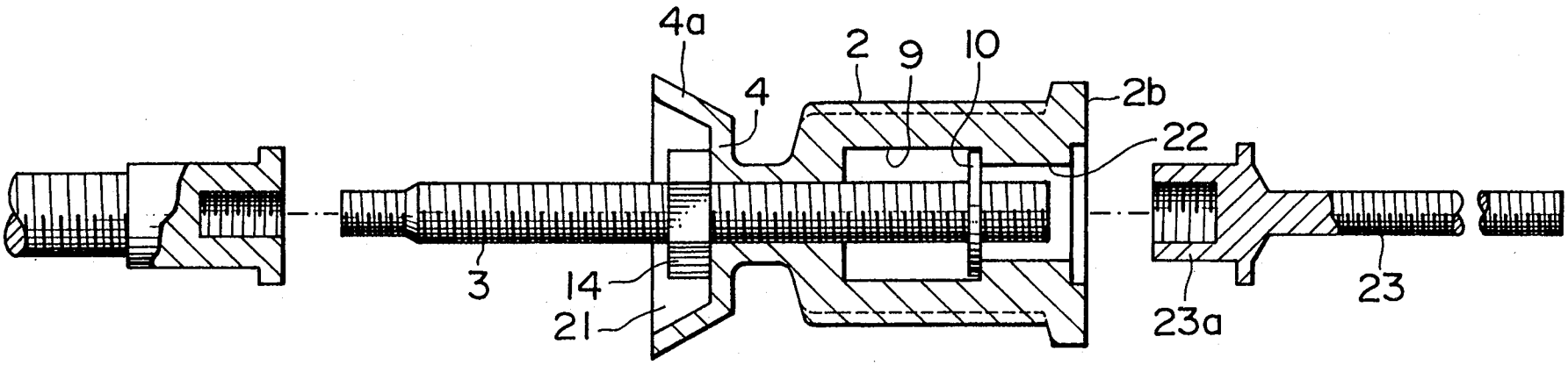
FIG. 8 is an exploded side view partiality in section, showing a fourth embodiment of heat insulating support tool for a concrete wall according to the present invention.

FIG. 8 illustrates a fourth embodiment of a heat insulating support tool for a concrete structure according to the present invention. The construction of this fourth embodiment is basically the same as that of the first embodiment, so the explanation of constructional points common to both will be omitted and explanation of different constructional points will be given below.

The outer periphery of a front flange **4*a* of a pedestal member 2 is formed with an extending portion 4*a* which is divergent obliquely outwards, and a rotating portion 14 of a fixing bolt member 3 is received in a recess 21 formed within the extending portion 4*a*. The rotating portion 14 is constituted by a nut which is fixed onto the fixing bolt member 3** in an approximately middle position.

Further, an annular projection 22 is formed on an inner surface part **2*b* side of a large-diameter hole portion 9 of the pedestal member 2, and a disk-like enlarged head portion 10 formed near the inside end of the fixing bolt member 3 is in abutment with the surface side of the annular projection 22, while a cap nut portion 23*a* of a special form tie 23 for space holding comes into abutment with the back side of the said annular projection. At the same time, the inside end of the fixing bolt member 3 is threadedly connected with the cap nut portion 23*a***.

By the above construction of this fourth embodiment there are attained the same functions and effects as in the first embodiment. Further, the fixing bolt member 3 and the special form tie 23 for space holding can be connected to and disconnected from each other. In this embodiment, moreover, in order to effect the disconnecting operation for the fixing bolt member 3 after concrete placing, a hole in a heat insulating member 50 through which the fixing bolt member 3 extends is formed large so as to permit the insertion and removal of a jig for operating the rotating portion 14 which is in the shape of a nut.

Figure 9:
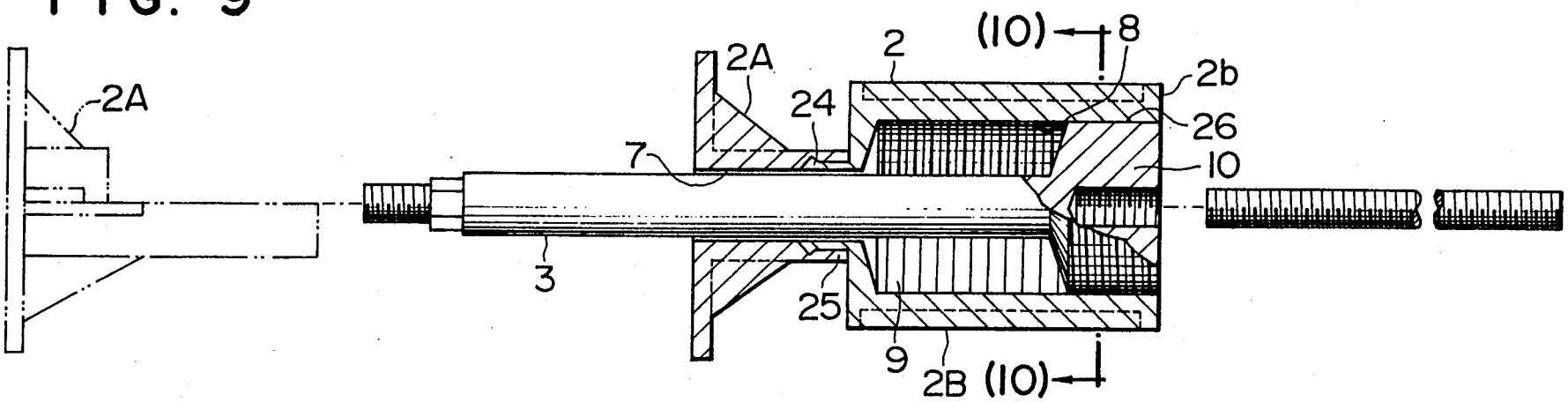
FIG. 9 is an exploded side view partially in section, showing a fifth embodiment of a heat insulating support tool for a concrete wall according to the present invention.
Figure 10:
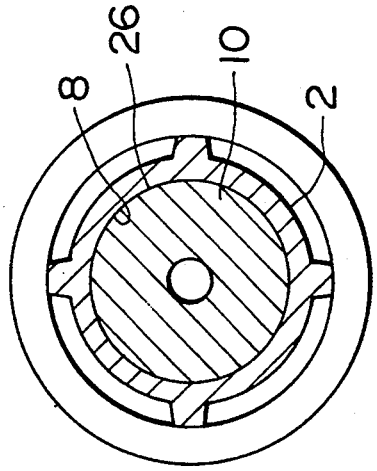
FIG. 10 is a sectional view taken on line (10)—(10) in FIG. 9.
Figure 11:
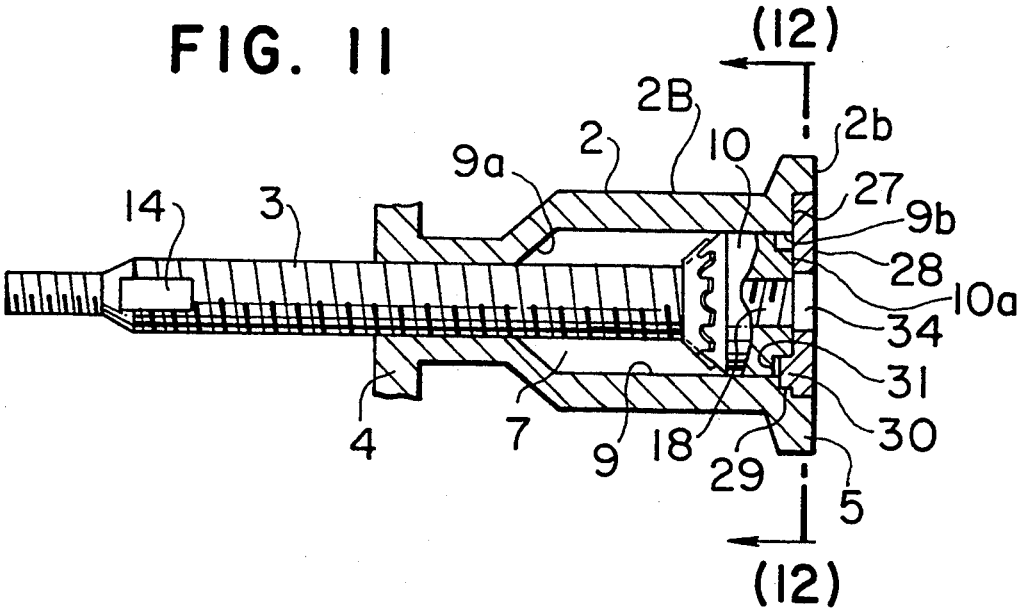
FIG. 11 is a side view partially in section, showing a sixth embodiment of a heat insulating support tool for a concrete wall according to the present invention.
Figure 12:
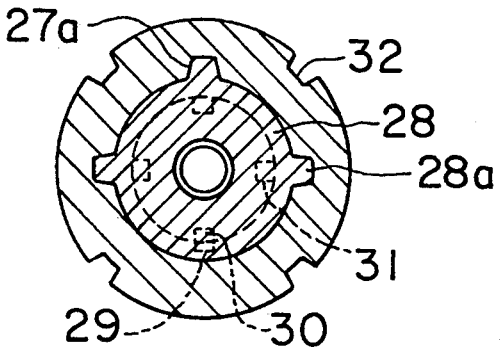
FIG. 12 is a sectional view taken on line (12)—(12) in FIG. 11.
Figure 13:
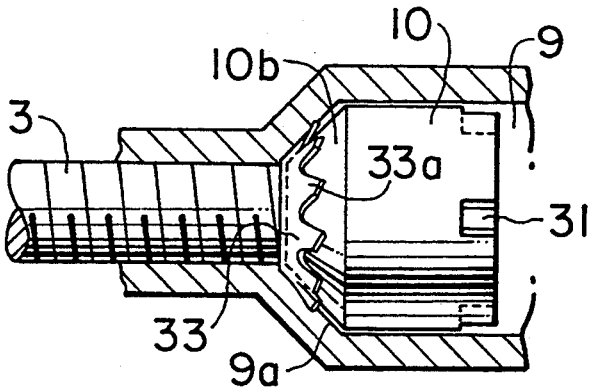
FIG. 13 is a partially enlarged side view partially in section, showing a fixing bolt member which has been moved to an outside position.
Figure 14:
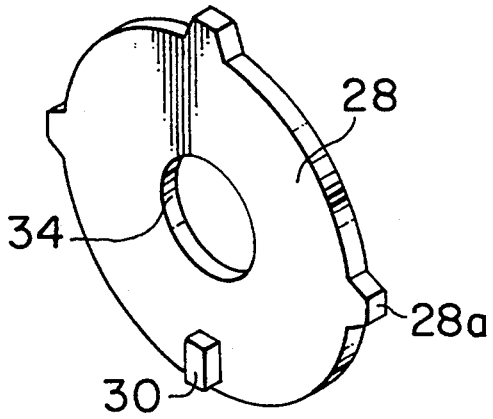
FIG. 14 is an enlarged perspective view of a cap member.

FIGS. 9 and 10 illustrate a fifth embodiment of a heat insulating support tool for a concrete wall according to the present invention. The construction of this fifth embodiment is basically the same as that of the first embodiment, so the explanation of constructional points common to both will be omitted and explanation of different constructional points will be given below.

A pedestal member 2 is divided into a surface-side portion 2A and a back-side portion 2B, and a to-be-connected portion 25 on the rear side of the surface-side portion 2A is connected detachably to a connecting portion 24 on the front side of the back-side portion **2*b*. As the surface-side portion 2A there is provided one having a suitable axial length so as to permit replacement when required. An internally threaded portion 8 is formed not in a through-hole 7 on the side of the surface-side portion 2A but in a large-diameter hole portion 9 formed in the back-side portion 2B. The internality threaded portion 8 is threadedly engaged with an externally threaded portion 26 formed on the outer periphery of an enlarged head portion 10 which is formed at an inside end of a fixing member 3** having a rod-like outer peripheral surface.

By the above construction of this fifth embodiment there are attained the same functions and effects as in the first embodiment. Further, the surface-side portion 2A can be replaced with another surface-side portion having a suitable length in accordance with the thickness of each form used in concrete placing.

FIGS. 11 to 14 illustrate a sixth embodiment of a heat insulating support tool for a concrete wall according to the present invention. The construction of this sixth embodiment is basically the same as that of the first embodiment, so the explanation of constructional points common to both will be omitted and explanation of different constructional points will be given below.

A fitting portion 27 is formed in a rear face **2*b* of a back-side portion 2B of a pedestal member 2 coaxially with a through-hole 7, and a cap member 28 is fitted in the fitting portion 27 to close an opening 9*b* of a large-diameter hole portion 9 and thereby prevent an inward movement of a fixing bolt member 3**.

The fitting portion 27 has recesses **27*a* formed radially in its inner peripheral surface, and lugs 28*a* formed on the outer peripheral edge of the cap member 28 are engaged with the recesses 27*a* to serve as a swivel stop for the cap member 28. Besides, an engaging lug 30 formed on the surface side of the cap member 28 is engaged with an engaging recess 29 formed in part of the opening 9*b* of the large-diameter hole portion 9 to make the swivel stop of the cap member 28 doubly sure. The engaging lug 30 is also engaged with an engaging recess 31 formed in an enlarged head portion 10 of the fixing bolt member 3 to restrict the rotation of the fixing bolt member 3** and also prevent an outward movement thereof.

In the peripheral side face of a rear flange 5 of the pedestal member 2 there are formed recesses 32 at equal intervals, and in an embedded state in concrete front and rear flanges 4, 5 hold the concrete therebetween to restrict axial movements of the pedestal member 2, while the recesses 32 are bonded with the concrete to restrict movements of the pedestal member around the axis thereof.

A suitable hole length of the large-diameter hole portion 9 is set in such a manner that the enlarged head portion 10 can move axially from an inside position in which it abuts the cap member 28 up to an outside position in which it abuts a bottom **9*a* of the large-diameter hole portion 9 after disconnection from a spacing holding bolt member 17**.

The fixing bolt member 3 a has engaging recesses 31 formed in four positions of an inside surface **10*a* of the enlarged head portion 10, and the engaging lug 30 of the cap member 28 is engaged with a nearby engaging recess 31 to prevent rotation of the fixing bolt member. According to this engagement relation, the engaged state between the engaging recess 31 in the enlarged head portion 10 and the engaging lug 30 of the cap member 28 is released forcibly by turning a rotating portion 14 of the fixing bolt member 3 and thereby destroying the engaging lug 30, so that the fixing bolt member 3** can be moved from its inside position to its outside position.

An outside surface **10*b* of the end enlarged head portion 10 is formed in a shape similar to the shape of a generality mortar-like bottom 9*a* of the large-diameter hole portion 9, and a washer 33 which is generally in the shape of a coned disc spring is disposed along and in contact with the outside surface 10*b*. The washer 33 has radially extending pawls 33*a* which are twisted clockwise around the projection axis. When the enlarged head portion 10 has moved to its outside position, the pawls 33*a* come into mesh with both the bottom 9*a* and the outside surface 10*b* to prevent reverse rotation of the fixing bolt member 3**.

Figure 15:
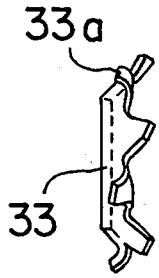
FIG. 15 is a side view showing another example of a washer.

Some of the pawls **33*a* may be folded back to the bottom 9*a* side (see FIG. 15) to enhance the strength of meshing with the bottom 9*a***.

The cap member 28 is formed in the shape of a plate similar to the shape of the fitting portion 27, with its lugs **28*a* projecting from its edge portion being engaged with the recesses 27*a*, and thus it is integrally mounted to the pedestal member 2. The engaging lug 30 of the cap member 28 is engaged with the engaging recess 31 of the enlarged head portion 10 in the inside position thereof to prevent rotation of the fixing bolt member 3. The engaging lug 30 is formed to have a projection strength which permits the engaging lug to be broken at its base portion and destroyed when a forced rotating force is applied thereto. More particularly, when the fixing bolt member 3 is rotated forcibly in its inside position and this rotating force is applied to the engaging lug 30 through the engaging recess 29, the lug 30** is broken and looses the aforesaid rotation preventing function.

The cap member 28 has a hole 34 formed centrally of its plate surface which closes the opening **9*b*. The spacing holding bolt member 17 is inserted through the hole 34 and brought into threaded engagement with an internally threaded portion 18 of the enlarged head portion 10, whereby it can be connected to the fixing bolt member 3**.

This construction affords the same effect as in the second embodiment. Further, since the opening **9*b* on the rear face 2*b* side of the pedestal member 2 is closed with the cap member 28 so that the fixing bolt member 3**, when moving inwards, comes into abutment with the cap member and is thereby prevented its rotating motion, it is possible to prevent the inward movement of the fixing bolt member.

Since the opening 9b of the pedestal member 2 is closed with the cap member 28, it is possible to prevent concrete and water from entering the large-diameter hole portion 9 at the time of concrete placing, so that the fixing bolt member 3 can be rotated without any trouble when it is to be moved outward.

Since not only the opening 9b on the rear face 2b side of the pedestal member 2 is closed with the cap member 28 and a pair of mutually engageable lug 30 and recess 31 are formed on the opposed surfaces of the cap member 28 and the enlarged head portion 10 of the fixing bolt member 3 to restrict the rotation of the fixing bolt member, it is also possible to prevent an outward movement of the fixing bolt member.

Since the engaging lug 30 of the cap member 28 is formed so as to be destroyed when it undergoes a forced rotating force, it is destroyed and looses its rotation preventing function as the fixing bolt member 3 rotates under an artificial forced rotating force, thus permitting the fixing bolt member to be moved to its outside position.

Since the washer 33 is provided on the outside surface of the enlarged head portion 10 of the fixing bolt member 3, when the fixing bolt member has been moved to its outside position, the pawls 33a of the washer 33 come into mesh with both the bottom 9a of the large-diameter hole portion 9 and the outside surface 10b of the enlarged head portion 10 to prevent reverse rotation of the fixing bolt member and serves as a looseness preventing means, so it is possible to fix the bolt member 3 in the outside position.

Figure 16:
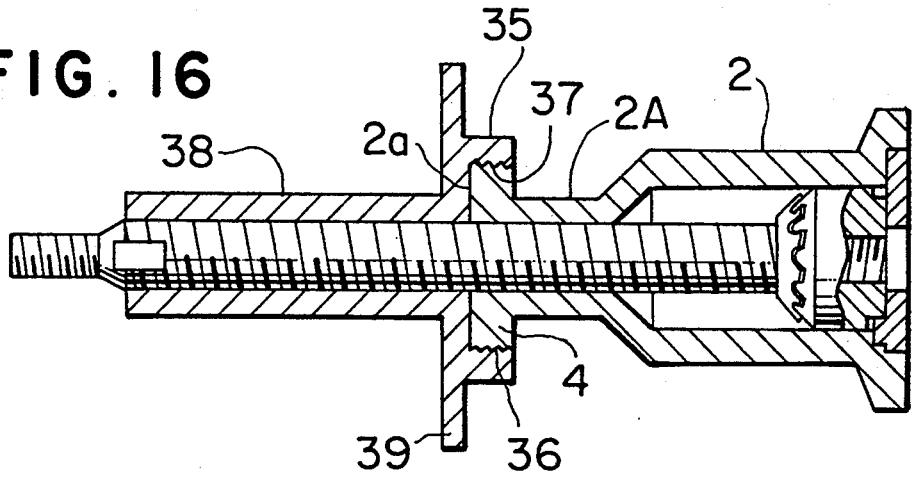
FIG. 16 is a side view partially in section, showing a seventh embodiment of a heat insulating support tool for a concrete wall according to the present invention.

FIG. 16 illustrates a seventh embodiment of a heat insulating support tool for a concrete wall according to the present invention. The construction of this seventh embodiment is basically the same as that of the sixth embodiment, so the explanation of constructional points common to both will be omitted and explanation of different constructional points will be given below.

A heat insulating spacer 35 is coaxially connected to a surfaces 2a of a surface-side portion 2A of a pedestal member 2. For this connection, an externally threaded portion 36 is formed on the outer peripheral surface of a front flange 4, while an internally threaded portion 37 is formed at an inside end of the heat insulating spacer 35, and both threaded portions are engaged with each other. The heat insulating spacer 35 has a cylindrical portion 38 capable of being inserted through a heat insulating member 50 which will be explained later in connection with a wall structure and also has an abutting flange portion 39 capable of coming into contact with the inside surface of the heat insulating member 50. The cylindrical portion 38 may be a separate portion.

By the above construction of this seventh embodiment there are attained the same functions and effects as in the sixth embodiment. Further, even in the case of a wall structure having a heat insulating member 50, the heat insulating spacer 35 can be replaced with a suitable length of a heat insulating spacer in accordance with the thickness of the heat insulating member 50.

Figure 17:
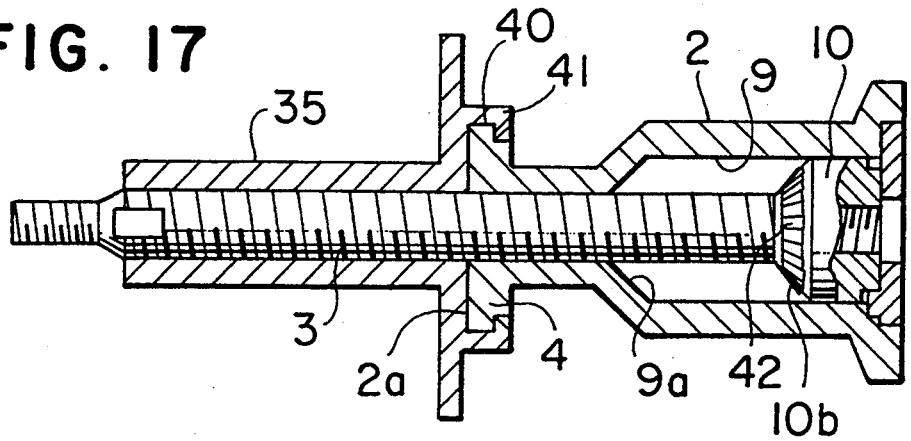
FIG. 17 is an exploded side view partially in section, showing an eighth embodiment of a heat insulating support tool for a concrete wall according to the present invention.
Figure 18:
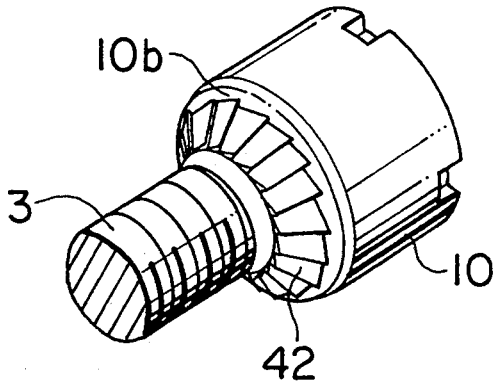
FIG. 18 is a partially enlarged perspective view of a fixing bolt member.
Figure 19:
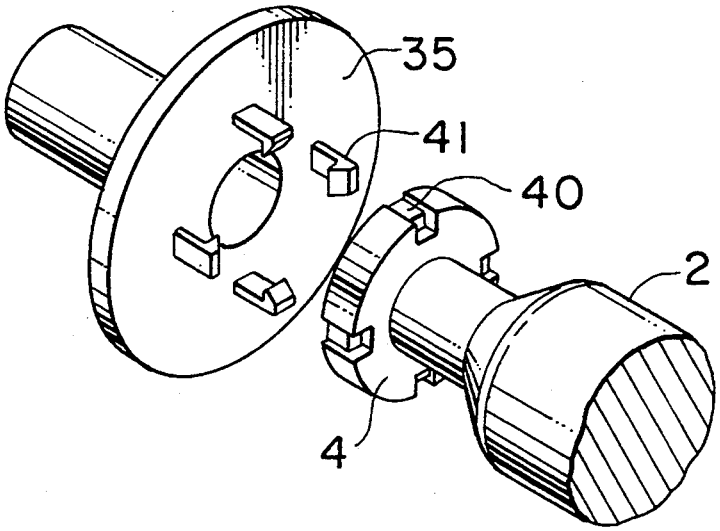
FIG. 19 is a partially enlarged perspective view of a pedestal member and a heat insulating spacer.

FIGS. 17 to 19 illustrate an eighth embodiment of a heat insulating support tool for a concrete wall according to the present invention. The construction of this eighth embodiment is basically the same as that of the seventh embodiment, the explanation of common constructional points will be omitted and explanation of different constructional points will be given below.

Retaining grooves 40 are formed axially in four positions of the outer peripheral surface of a front flange 4 of a pedestal member 2, and hook-shaped retaining pawls 41 formed at an inside end of a heat insulating spacer 35 are respectively engaged with the retaining grooves 40 to connect the heat insulating spacer 35 coaxially with a surface 2a.

An enlarged head portion 10 of a fixing bolt member 3 has pawls 42 formed radially and projectingly in a generally continuous saw-teeth shape in section on an outside surface 10b whose shape is similar to the shape of a generally mortar-shaped bottom 9a of a large-diameter hole portion 9. When the enlarged head portion 10 has moved to its outside position, the pawls 42 come into mesh with the bottom 9a to prevent reverse rotation of the fixing bolt member 3.

By this construction there are attained the same functions and effects as in the seventh embodiment. Further, since the washer 33 used in the preceding embodiment is not used, it is possible to attain both reduction in the number of parts and labor-saving in the assembling process. Besides, since the heat insulating spacer 35 is connected to the pedestal member 2 and is swivel-stopped, there is no fear of its loosening and disengagement.

Figure 20:
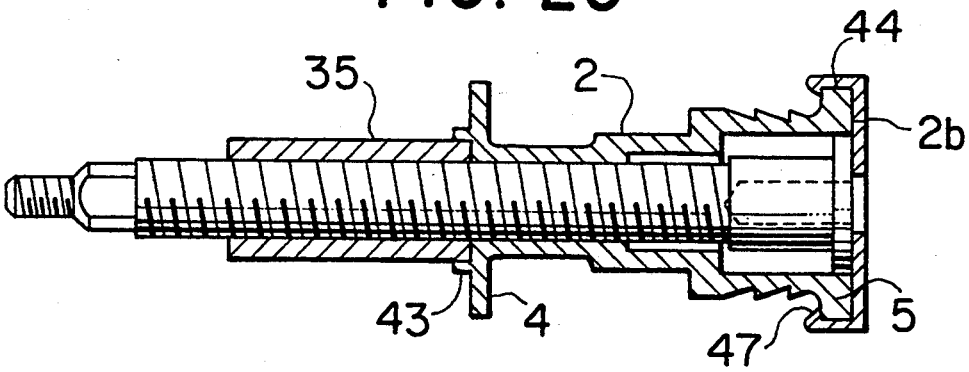
FIG. 20 is a side view partially in section, showing a ninth embodiment of a heat insulating support tool for a concrete wall according to the present invention.
Figure 21:
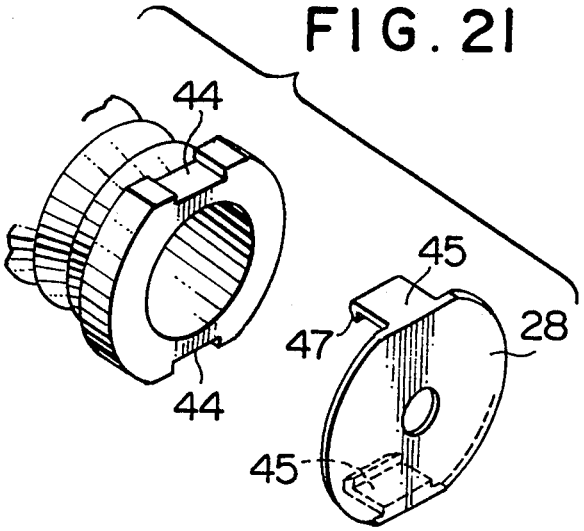
FIG. 21 is a partially enlarged perspective view of a pedestal member and a cap member.

FIGS. 20 and 21 illustrate a ninth embodiment of a heat insulating support tool for a concrete wall according to the present invention. The construction of this ninth embodiment is basically the same as that of the eighth embodiment except that the pawls 42 used in the preceding embodiment are not used in this embodiment. Therefore, the explanation of common constructional points will be omitted and only different constructional points will be explained below.

A pedestal member 2 has a ring 43 provided coaxially and projectingly on the surface side of a front flange 4, and the base portion of a cylindrical heat insulating spacer 35 is inserted and connected coaxially into the projecting ring 43.

In the outer peripheral surface of a rear flange 5 of the pedestal member 2 there are formed retaining grooves 44 in top and bottom positions, and retaining pieces 45 of a cap member 28 are respectively engaged with the top and bottom retaining grooves 44.

The cap member 28 is formed in the same shape as the contour of a rear face 2b of the pedestal member 2, and the retaining pieces 45 project horizontally in top and bottom positions from the outer periphery of the cap member 28 and are engaged in the retaining grooves 44 of the rear flange 5. Further, a hook-shaped flange portion 47 formed at the front end of each retaining piece 45 gets over the associated retaining groove 44 and comes into elastic engagement with the surface side of the groove edge, whereby the cap member 28 is prevented from dislodging and swiveling with respect to the rear face 2b.

By this construction there are attained the same functions and effects as in the eighth embodiment. Additionally, the working efficiency can be improved because the mounting method for the cap member 28 is an external fitting method.

Figure 22:
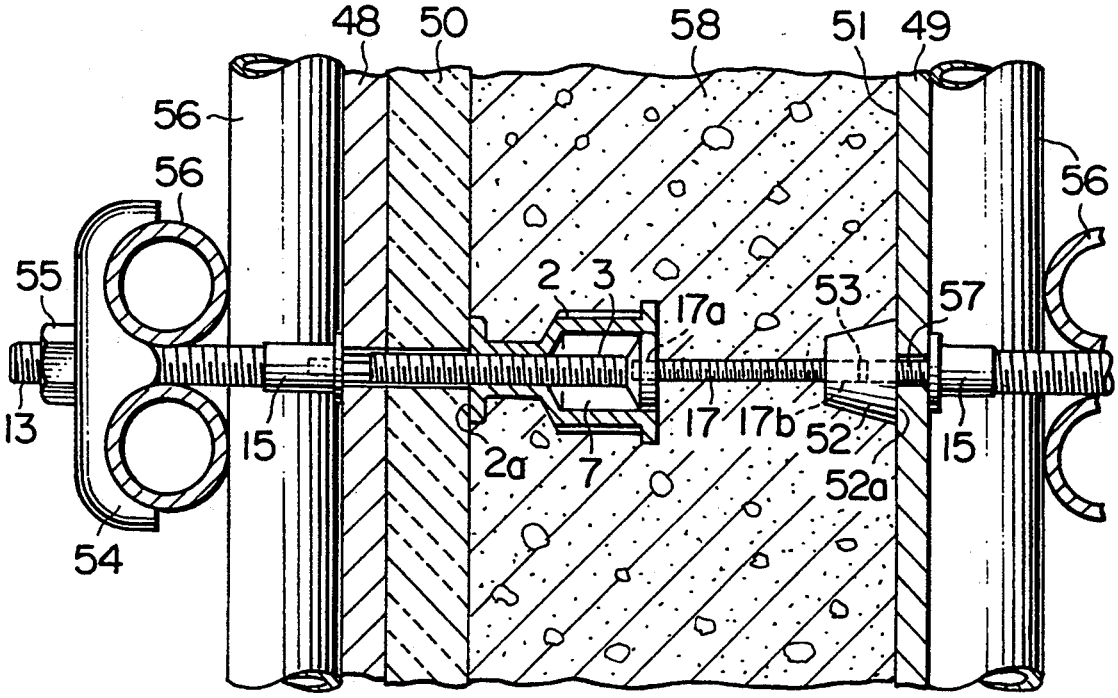
Figure 23:
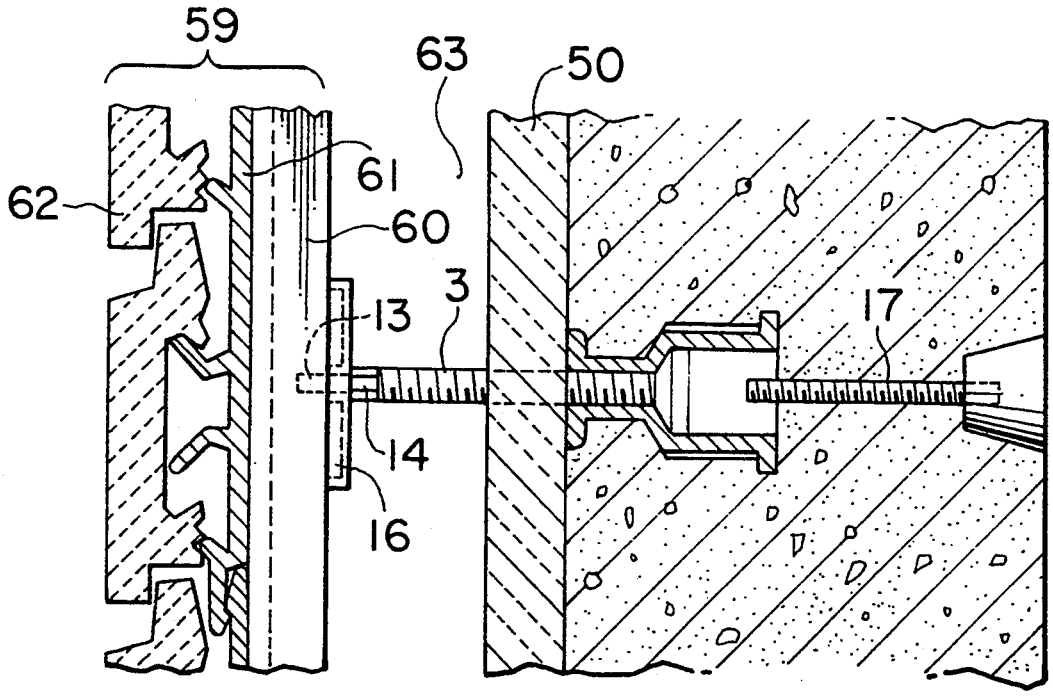

FIGS. 22 and 23 illustrate, in the order of execution of work, a first embodiment of a concrete wall structure according to the present invention, using the support 1 of the foregoing first embodiment.

First Process (see FIG. 22)

A heat insulating member 50 and a surface-side form 48 are disposed on the surface side, while a back-side form 49 is disposed on the back side, to form a concrete placing space 51 between both forms 48 and 39. In the concrete placing space 51, the surface part 2a of the pedestal member 2 is brought into abutment with the inside surface of the heat insulating member 50, while a rear face 52a of the holding member 52 is brought into abutment with the inside surface of the back-side form 49. Further the opposite end portion 17b of the spacing holding bolt member 17 is threadedly engaged with an internally threaded portion 53 of the holding member 52, while one end portion 17a of the bolt member 17 is threadedly connected with the inside end of the fixing bolt member 3 extending through the through-hole 7 of the pedestal member 2.

The presser means holding bolt member 15 is threadedly engaged with the threaded portion 13 of the fixing bolt member 3 which portion projects to the surface side through the surface-side form 48, and a presser means holder 54 of the bolt member 15 is prevented from dislodging using a nut 55 to fix surface-side presser means 56 such as vertical battens and horizontal battens in abutment with the surface-side form 48. Likewise, a presser means holding bolt member 15 is threadedly engaged with a bolt portion 57 which projects from the rear face 52a of the holding member through the back-side form 49, and a presser means holder of the bolt member 15 is prevented from dislodging using a nut to fix back-side presser means 56 such as vertical battens and horizontal battens in abutment with the back-side form 49.

Second Process

After hardening of concrete 58, the presser means holding bolt member 15 is removed from the threaded portion 13 of the fixing bolt member 3 on the surface side; at the same time, the bolt portion 57 and the presser means holding bolt member 15 are removed from the holding member 52 on the back side, then the surface and back-side forms 48, 49 are removed.

Third Process

Next, a jig is applied to the rotating portion 1 of the fixing bolt member 3 which portion is projecting from the heat insulating member 50 and is turned to disconnect the fixing bolt member from the spacing holding bolt member 17 and adjust the projection level of the threaded portion 13. Then, the level adjuster 16 is brought into threaded engagement with the threaded portion 13.

Fourth Process (see FIG. 23)

A rafter 60 as a finish member 59 is fixed onto the threaded portion 13 of the bolt member 3 while its vertical condition is adjusted using the level adjuster 16, then tile 62 is attached to a support member 61 mounted on the surface side of the rafter 60. Between the surface of the heat insulating member 50 and the back of the finish member 59 is formed an air layer 63.

In the concrete wall structure thus fabricated, there is no fear of the pedestal member 2 being destroyed and the concrete placing space 51 impaired by impact and tensile forces induced at the time of concrete placing. Besides, after hardening of concrete, since the fixing bolt member 3 and the spacing holding bolt member 17 are disconnected and separated from each other, the concrete wall structure is superior in the outside insulation performance and the influence of heat bridge and cool bridge does not reach the concrete 8.

Further, since the fixing bolt member 3 is turned and drawn out suitably and then the finish member 59 is fixed onto the threaded portion 13 formed at the front end of the fixing bolt member, the concrete surface can be finished using a desired finish member 59 out of those having various thicknesses by merely adjusting the projection level of the bolt member 3.

Even in the case where the pedestal member 2 is made of resin and melts due to a fire for example after concrete placing, the enlarged head portion 10 abuts the concrete hole portion at the site of the surface-side portion 2A of the pedestal member and is thereby prevented from dislodging, so that the finish member 59 does not fall from the concrete wall and thus the wall structure has a high safety.

Since the application of the finish member 59 is performed using the threaded portion 13 of the fixing bolt member 3 as a support portion of the finish member 59, the working efficiency is improved remarkably, thus leading to shortening of the term of work, in comparison with the prior art using an anchor. Besides, the fixing bolt member 3 for the finish number 59 is embedded in the concrete 58 through the pedestal member 2, it is possible to obtain a high mounting strength in comparison with a wall structure using a post-driven anchor.

Further, since the threaded portion 13 of the fixing bolt member 3 is used as a mounting portion for the bolt member 15 which is for holding the presser means 56 such as vertical battens and horizontal battens the structure is simplified and the working efficiency is high.

Since the air layer 63 is interposed between the heat insulating member 50 and the finish member 59, even if the mounting of the finish member 59 is performed before complete hardening of concrete, the drying of concrete proceeds because of the presence of the air layer 63 and thus the finish member can be mounted without waiting for the lapse of the so-called concrete curing period. This point is effective in shortening the term of work.

It is possible to obtain a concrete wall structure having a tiled surface.

Figure 24:
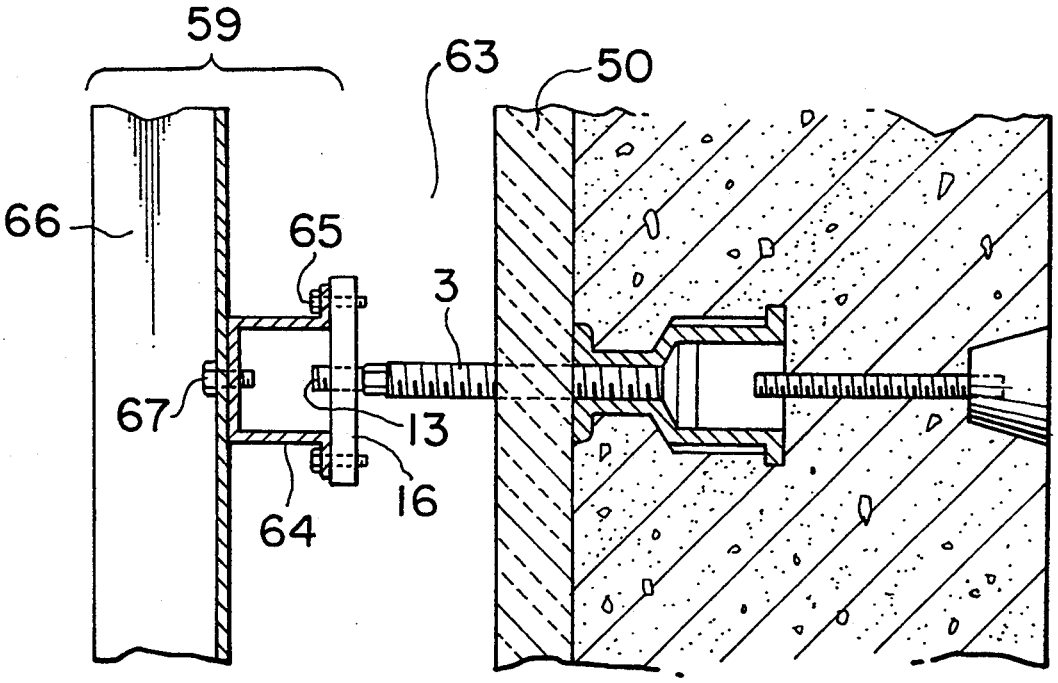
FIG. 24 is a vertical sectional view illustrating a second embodiment of a concrete wall structure according to the present invention.

FIG. 24 illustrates a second embodiment of a concrete wall structure according to the present invention, using the support tool 1 of the foregoing first support tool embodiment. The construction of this embodiment is basically the same as that of the first wall structure embodiment, so the explanation of common constructional points will be omitted and only different constructional points will be explained below.

A rafter 6 as a finish member 59 is fixed, using fixing means 65 such as machine screws or the like, to level adjuster 16 mounted on threaded portion 13 of the fixing bolt member 3 projecting from a heat insulating member 50, and a square-wave like metal plate 66 is attached to the surface side of the rafter 64 using fixing means 67 such as machine screws or the like. An air layer 63 is formed between the heat insulating member 50 and the back of the finish member 59.

This construction can afford the same functions and effects as in the preceding embodiment. Further, it is possible to obtain a concrete wall structure having a surface formed by the square wave-like metal plate 66.

Figure 25:
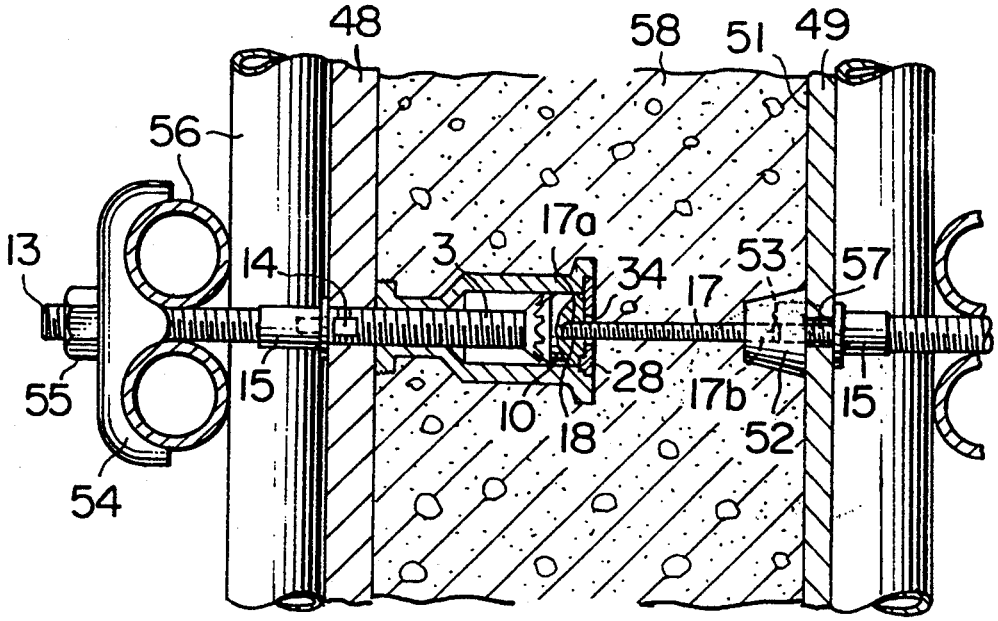
Figure 26:
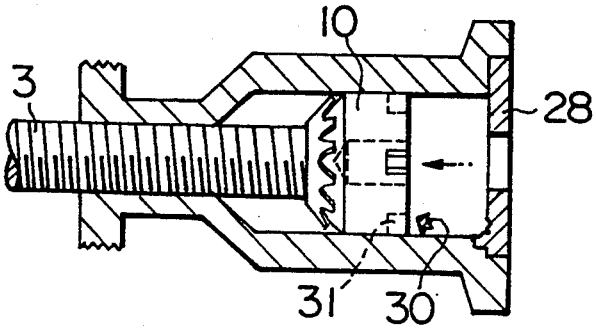
Figure 27:
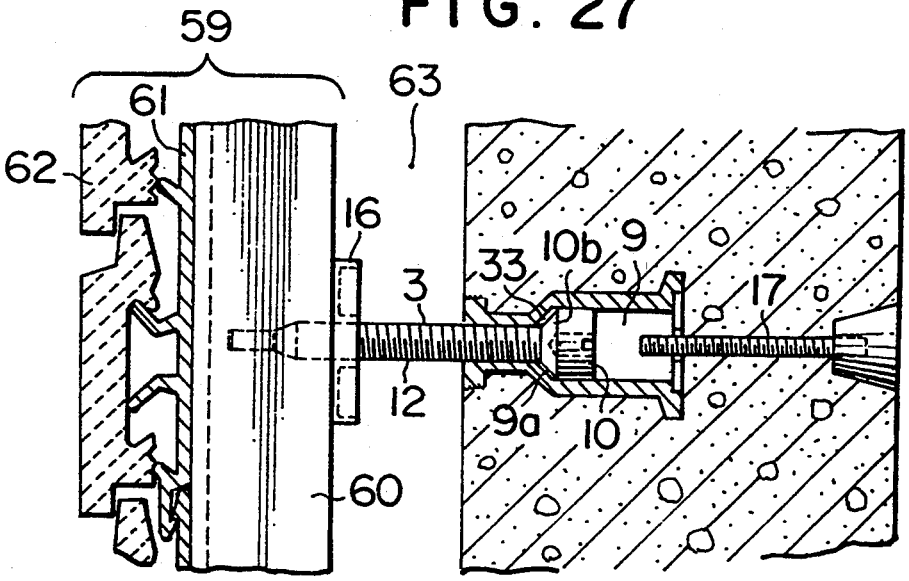

FIGS. 25 to 27 illustrate, in the order of execution of work, a third embodiment of a concrete wall structure according to the present invention, using the support tool of the foregoing sixth support tool embodiment.

First Process (see FIG. 25)

A surface-side form 48 and a back-side form 49 are disposed on the surface side and the back side, respectively, to form a concrete placing space 51 therebetween. In the concrete placing space 51, the pedestal member 2 is disposed in abutment with the surface-side form 48, while a holding member 52 is disposed in abutment with the inner surface of the back-side form 49. Further, an outside end 17*b* of the spacing holding bolt member 17 is threadedly engaged with an internally threaded inserting portion 53 of the holding member 52, then an inside end 17*a* of the spacing holding bolt member 17 is inserted through the hole 34 of the cap member 28 and is threadedly connected with the internally threaded portion 18 formed in the enlarged head portion 10 of the fixing bolt member 3.

A bolt member 15 for holding presser means is threadedly engaged with a threaded portion 13 of the fixing bolt member 3 which portion projects to the surface side through the surface-side form 48, and a presser means holder 54 of the bolt member 15 is prevented from dislodging using a nut 55 to fix surface-side presser means 56 such as vertical battens and horizontal battens in abutment with the surface side form 48. Likewise, a bolt member 15 for holding presser means is threadedly engaged with a bolt portion 57 which projects from the holding member 52 through the back-side form 49, and a presser means holder of the bolt member 15 is prevented from dislodgement using a nut to fix back-side presser means such as vertical battens and horizontal battens in an abutted state with the back-side form 49. Thereafter, concrete deposited in the concrete placing space 51.

Second Process

After hardening of the concrete, indicated by a numeral 58, the presser means holding bolt member 15 is removed from the threaded portion 13 of the fixing bolt member 3 on the surface side, and at the same time the presser means holding bolt member 15 is removed from the holding member 52 on the back side, then the surface- and back-side forms 48, 49 are removed.

Third Process (see FIG. 26)

Next, a jig is applied to the rotating portion 14 of the fixing bolt member 3 projecting from the concrete as wall surface and the rotating portion 14 is turned forcibly thereby to destroy an engaging lug 30 of the cap member 28 which is engaged with an engaging recess of the enlarged head portion 10.

Fourth Process (see FIG. 27)

The fixing bolt member 3 is disconnected from the spacing holding bolt member 17 and is moved to its outside position and fixed in the same position by means of the washer 33 which is in mesh with both the bottom 9*a* of the large-diameter hole portion 9 and the outside surface 10*b* of the enlarged head portion 10.

A level adjuster 16 is brought into threaded engagement with an externally threaded portion 12 of the fixing bolt member 3, and a rafter 60 as a finish member 59 is fixed to the level adjuster 16, then tile 62 is mounted to a support member 61 on the surface side of the rafter 60. Further, an air layer 63 is formed between the concrete wall surface and the finish member 59.

The concrete wall structure thus fabricated exhibits the same effects as in the first wall structure embodiment. Additionally, the rotation of the fixing bolt member 3 is restricted and co-rotation thereof with the spacing holding bolt member 17 and the presser means holding bolt member 15 is prevented, so that the mounting of the bolt member 15 can be done easily. Further, the concrete placing space 51 of a predetermined width is ensured and so it is possible to obtain a wall structure having a designed width.

Since the fixing bolt member 3 in its outside position is fixed against reverse rotation by means of the washer 33, the mounting of the finish member 59 is easy.

Further, since the mounting of the finish member 59 is performed using the externally threaded portion 12 of the fixing bolt member 3 as a support portion for the finish member, the working efficiency is improved remarkably, thus leading to shortening of the term of work, as compared with the prior art using anchor.

Figure 28:
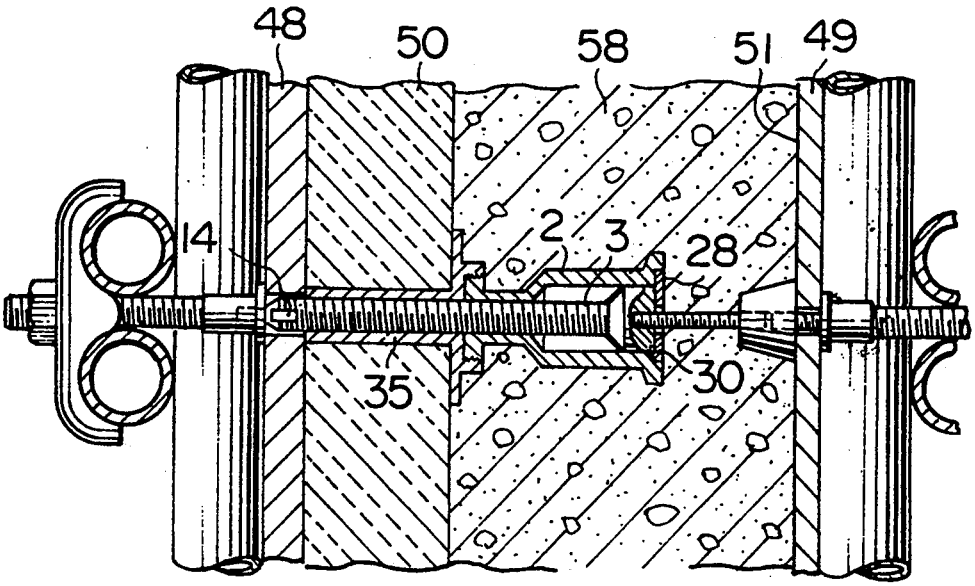
Figure 29:
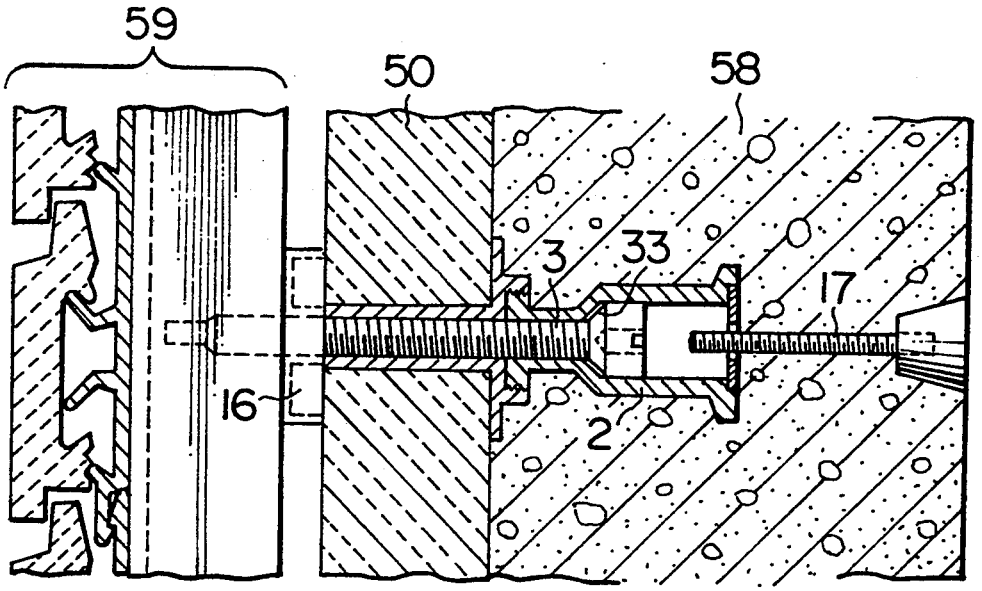

FIGS. 28 and 29 illustrate a fourth embodiment of a concrete wall structure according to the present invention, using the support tool of the foregoing seventh support tool embodiment. The construction of this embodiment is basically the same as in the third wall structure embodiment, so the explanation of common constructional points will be omitted and only different constructional points will be explained below.

First Process (see FIG. 28)

In a concrete placing space 51, the heat insulating spacer 35 of the pedestal member 2 is inserted through the heat insulating member 50.

Second Process

Forms 48 and 49 are removed after hardening of the concrete.

Third Process

A jig is applied to a rotating portion 14 of a fixing bolt member 3 projecting from the heat insulating member 50 and the rotating portion is turned forcibly thereby to destroy an engaging lug 30 of a cap member 28.

Fourth Process (see FIG. 29)

The fixing bolt member 3 is disconnected from a spacing holding bolt member 17 and is moved to its outside position, then is fixed in that position by means of a washer 33. A finish member 59 is attached to a level adjuster 16 of the fixing bolt member 3.

The concrete wall structure thus fabricated exhibits the same effects as in the wall structure of the third wall structure embodiment. Additionally, even when the wall so structure has the heat insulating member 50, it is possible to effect positioning of the pedestal member 2 easily.

What is claimed is:

1. A support tool for use in the fabrication of a concrete wall, said support tool comprising:

a pedestal member having a through-hole extending axially through said pedestal member from a front surface portion of a front flange portion to a back surface portion of a rear flange portion, said through-hole having a hole portion formed in the rear flange portion that has a larger inside diameter than that of a hole portion formed in the front flange portion;

a fixing rod-like member extending through said through-hole, said fixing rod-like member having a rotating member at a front end thereof and an enlarged head member at a rear end thereof, an outside diameter of said enlarged head member being smaller than the diameter of the hole portion of the rear flange portion, the front end of said fixing rod-like member protruding from the hole portion of the front flange portion;

a spacing holding rod-like member embedded in the concrete wall; and means for connecting one end of said spacing holding rod-like member to said fixing rod-like member so that the connection of said spacing holding rod-like member and said fixing rod-like member can be released by rotating said rotating member.

2. A support tool according to claim 1, wherein said pedestal member has an internally threaded portion formed in said through-hole, an externally threaded portion of said fixing rod-like member being threadingly engaged with said internally threaded portion so that a projection length of said fixing rod-like member from said pedestal member is adjustable relative to said pedestal member.

3. A support tool according to claim 1, wherein said pedestal member has an internally threaded portion formed in said through-hole, an externally threaded portion of said fixing rod-like member being threadingly engaged with said internally threaded portion, said connecting means comprising an internally threaded portion formed in an inner surface of said enlarged head portion and a cap member that is disposed to close an opening of the hole portion formed in the rear flange portion of said pedestal member, said spacing holding rod-like member being connected through a central hole portion of said cap member to said internally threaded portion of said enlarged head member such that the connection therebetween can be released by rotating said rotating member of said fixing rod-like member.

4. A support tool according to claim 1, wherein said pedestal member portion has an internally threaded portion formed in said through-hole, an externally threaded portion of said fixing rod-like member being threadingly engaged with said internally threaded portion, said support tool further comprising a reverse rotation preventing element including pawls for meshing with a bottom surface of said hole portion of said rear flange, said pawls being formed on an outside surface of said enlarged head member.

5. A support tool according to claim 1, wherein said pedestal member has an internally threaded portion in said through-hole, an externally threaded portion of said fixing rod-like member being threadingly engaged with said internally threaded portion, said support tool further comprising a rotating preventing element and a cap member that is arranged to close an opening of the hole portion of the rear flange portion and includes a hole for insertion of said spacing holding rod-like member therethrough, said rotation preventing element including an engaging projection and an engaging recess, formed on opposed surfaces of said enlarged head member and said cap member and being mutually engageable with one another, said engaging projection including means for breaking the engaging projection when it undergoes a predetermined rotating force.

6. A support tool according to claim 1, wherein said pedestal member includes a surface-side portion and a back-side portion, said surface-side portion being axially movable relative to said back-side portion.

7. A support tool according to claim 1, wherein the hole portion of said rear flange portion comprises means for restricting relative rotating motion between said pedestal member and said fixing rod-like member due to an impact or vibration during concrete placing.

8. A support tool according to claim 1, wherein said enlarged head member of said fixing rod-like member is positioned within the hole portion of the rear flange portion of said pedestal member and has a diameter that is larger than an outside diameter of the hole portion of the front flange portion.

9. A support tool according to claim 1, wherein said spacing holding rod-like member is embedded in the concrete of the concrete wall that is received in a concrete placing space defined between a surface-side form and a back-side form.

10. A support tool according to claim 9, wherein the other end of said spacing holding rod-like member is connected to a holding member, the front surface portion of said pedestal member and a back surface portion of the holding member being arranged in abutment with inner surfaces of said surface-side form and said back-side form, respectively, said spacing holding rod-like member being disposed between said pedestal member and said holding member.

11. A support tool of claim 10, further comprising a cap member that is arranged to close an opening of the hole portion of the rear flange portion of said pedestal member and that includes an axially centered hole, a pedestal member-side end portion of said spacing holding rod-like member being passed through the hole of said cap member and having an externally threaded portion for threadingly engaging an internally threaded portion of said enlarged head member.

12. A support tool of claim 10, further comprising means for rotating said fixing rod-like member so that it may be disconnected from said spacing holding rod-like member after the concrete deposited in said concrete placing space has hardened, means for rotatably drawing said fixing rod-like member outwardly from said front flange portion of said pedestal member by a predetermined length, and means for connecting a finish member on the front end of said fixing rod-like member projecting outwardly from said front flange portion.

13. A support tool of claim 12, wherein an air layer is defined between said surface-side form and said finish member.

14. A support tool of claim 12, wherein a heat insulating spacer is arranged between said surface-side form and said pedestal member and coaxially with said fixing rod-like member, an inner surface portion of said heat insulating spacer being threadingly connected with the front surface portion of said pedestal member.

15. A support tool of claim 12, wherein a heat insulation spacer is arranged between said surface-side form and said pedestal member and coaxially with said fixing rod-like member, the front surface portion of said pedestal member being formed with retaining grooves that are axially engageable with retaining pawls formed in said heat insulating spacer.

* * * * *

UNITED STATES PATENT AND TRADEMARK OFFICE

CERTIFICATE OF CORRECTION

PATENT NO. : 5,415,510

DATED : May 16, 1995

INVENTOR(S) : M. FUNAKI et al.

It is certified that error appears in the above-indentified patent and that said Letters Patent is hereby corrected as shown below:

On the Title page, in section [56], "References Cited", "FOREIGN PATENT DOCUMENTS", line 3, change "128779" to --- 1288779---.

Signed and Sealed this

Eighth Day of April, 1997

Bruce Lehman

*Attest:*

BRUCE LEHMAN

*Attesting Officer*

*Commissioner of Patents and Trademarks*